US007862018B2

(12) United States Patent
Tautz

(10) Patent No.: US 7,862,018 B2
(45) Date of Patent: Jan. 4, 2011

(54) APPARATUS FOR CUTTING INTO LENGTHS AND BRINGING TOGETHER A SPINE STRIP WITH COVER BOARDS FOR THE MECHANIZED PRODUCTION OF BOOK CASES

(75) Inventor: Frank Tautz, Rahden (DE)

(73) Assignee: Kolbus GmbH & Co. KG, Rahden (DE)

( * ) Notice: Subject to any disclaimer, the term of this patent is extended or adjusted under 35 U.S.C. 154(b) by 732 days.

(21) Appl. No.: 11/818,864

(22) Filed: Jun. 15, 2007

(65) Prior Publication Data

US 2007/0292242 A1 Dec. 20, 2007

(30) Foreign Application Priority Data

Jun. 17, 2006 (DE) ..... 10 2006 027 903

(51) Int. Cl.
*B65H 37/04* (2006.01)

(52) U.S. Cl. ..... 270/52.01; 270/5.02; 270/5.03; 270/52.07; 270/52.09

(58) Field of Classification Search ..... 270/5.02, 270/5.03, 52.01, 52.07, 52.09, 52.13, 21.1; 412/3, 11, 13, 16, 17
See application file for complete search history.

(56) References Cited

U.S. PATENT DOCUMENTS

| | | | | |
|---|---|---|---|---|
| 5,409,340 | A | 4/1995 | Engert | |
| 5,716,190 | A * | 2/1998 | Rathert | 414/794.3 |
| 6,687,569 | B1 * | 2/2004 | Skinger et al. | 700/220 |
| 6,769,676 | B2 * | 8/2004 | Machon et al. | 270/58.23 |
| 2007/0018373 | A1 * | 1/2007 | Shoji et al. | 270/4 |

FOREIGN PATENT DOCUMENTS

| | | | |
|---|---|---|---|
| DE | 36 14 167 | A1 | 10/1987 |
| DE | 100 57 600 | A1 | 5/2002 |
| EP | 0 631 957 | A2 | 1/1995 |

OTHER PUBLICATIONS

Search Report for German Application No. 10 2006 027 903.4.

* cited by examiner

*Primary Examiner*—Leslie A Nicholson, III
(74) *Attorney, Agent, or Firm*—Alix, Yale & Ristas, LLP

(57) ABSTRACT

In an apparatus for cutting to length sections of a spine insert (1) that is unwound from a supply reel and for bringing together the spine inserts with infed cover boards (8) in a roller applicator (5, 6) for the mechanized production of book cases, the invention proposes that the pair of cut length transport rollers (3.1) for drawing forward a defined drawing-off length (L) of the spine insert (1) and for positioning the spine insert in the cutting device (9) and the pairs of feed rollers (4.1, 4.2, 4.3) for transporting the cut-to-length spine inserts (1) into the roller applicator (5, 6) through a transport channel (2) can be driven independently of one another, wherein the pairs of feed rollers (4.1, 4.2, 4.3) can be intermittently driven in a cyclic fashion with a constant stroke ($H_Z$) while the pair of cut length transport rollers (3.1) carry out the transport stroke ($H_S$), that is variable due to the drawing-off length (L) and features a first motion segment (20*a*) for synchronizing with the transport movement of the pairs of feed rollers (4.1, 4.2, 4.3) and a second motion segment (20*c, b*) in which the pair of cut length transport rollers is synchronized with the pairs of the feed rollers (4.1, 4.2, 4.3) and transports the spine insert (1) together with the pairs of feed rollers.

7 Claims, 2 Drawing Sheets

APPARATUS FOR CUTTING INTO LENGTHS AND BRINGING TOGETHER A SPINE STRIP WITH COVER BOARDS FOR THE MECHANIZED PRODUCTION OF BOOK CASES

BACKGROUND

The present invention pertains to an apparatus for cutting into lengths and bringing together a spine insert with cover boards for the mechanized production of book cases.

An apparatus of this type is known from EP 0 631 957 B1. A pair of cut length transport rollers for drawing the spine insert forward and for positioning the spine insert in a cutting device and a series of pairs of feed rollers for transporting the cut-to-length spine insert through a transport channel and into the roller applicator are cyclically driven by a jointly controlled servomotor. After a drawing-off length has been reached, the spine insert is clamped by a pneumatic cylinder while the spring-loaded pressing roller is separated from the roller that is directly driven by the servomotor in order to open the pair of rollers. The spine insert is cut off the material strip and transported into a waiting position by the pairs of feed rollers that now represent the only effective rollers. Subsequently, the clamping of the spine insert is released and the pair of cut length transport rollers is closed again. After the detection of a front edge of the infed cover boards, the cut-to-length spine insert is transported into the roller applicator in synchronism with the cover boards while an ensuing spine insert is simultaneously drawn forward by the defined drawing-off length.

A high cutting accuracy is achieved because the spine insert is at a standstill while it is cut off. The spine insert and the cover boards are brought together in a positionally accurate fashion as a result of the synchronous infeed of the spine insert to the cover boards by the pairs of feed rollers. The disadvantages of this apparatus can be seen in the intermediate transport of the spine insert into the waiting position and the pneumatic switch-over for opening and closing the pair of cut length transport rollers and for clamping and releasing the material strips, respectively, such that the maximum output per cycle is limited.

SUMMARY

The present disclosure is based on the objective of developing an apparatus for cutting into lengths and bringing together a spine insert with cover boards for the mechanized production of book cases, which apparatus has a simple construction and allows a positionally accurate infeed of spine inserts that are very precisely cut to length as well as a high output per cycle.

This objective is attained in that the pair of cut length transport rollers and the pairs of feed rollers can be driven independently of one another, in that the pairs of feed rollers can be intermittently driven in a cyclic fashion and with a constant transport stroke, and in that the pair of cut length transport rollers has a transport stroke that is composed of a first motion segment that takes place for synchronizing with the transport movement of the pairs of feed rollers and a second motion segment that takes place in synchronism with the pairs of feed rollers and in which the pair of cut length transport rollers conveys the spine insert together with the pairs of feed rollers in order to carry out the transport stroke that is variable due to the drawing-off length. The apparatus does not require an intermediate transport of the cut-to-length spine insert into a waiting position, and the clamping and releasing of the material strips in the cutting device or the opening and closing of the pair of cut length transport rollers can be eliminated such that the infeed of cut-to-length spine inserts can take place in rapid succession.

According to one practical embodiment, the first pair of feed rollers is arranged at a defined transport distance from the cutting device that can be used as a transport section for carefully accelerating and synchronizing the transport movement of the pair of cut length transport rollers with the transport movement of the pairs of feed rollers.

While the spine insert and the cover boards are brought together, the spine insert is preferably conveyed in synchronism with the infed cover boards by the pairs of feed rollers.

It is practical that the last pair of feed rollers is arranged at a defined transport distance from the roller applicator that can be used as a transport section for decelerating the common transport movement of the pair of cut length transport rollers and the pairs of feed rollers while the new spine insert is drawn forward and after the previously infed spine insert has departed the aforementioned last pair of feed rollers. While the spine insert is additionally transported in the transport channel by the roller applicator, the pairs of feed rollers and the pair of cut length transport rollers can be carefully decelerated.

The pair of cut length transport rollers and the pairs of feed rollers preferably have separate servomotors in order to realize the advantages of a simple construction and of easily accommodating a change in length and/or position of the spine insert while the apparatus is in operation.

According to an advantageous additional development, two or more pairs of cut length transport rollers are arranged within certain distances from one another such that a slip-free transport is ensured, in particular, when processing heavy material strips.

BRIEF DESCRIPTION OF THE DRAWING

An embodiment of the invention is described below with reference to the drawing, in which.

DETAILED DESCRIPTION

Figure 1:
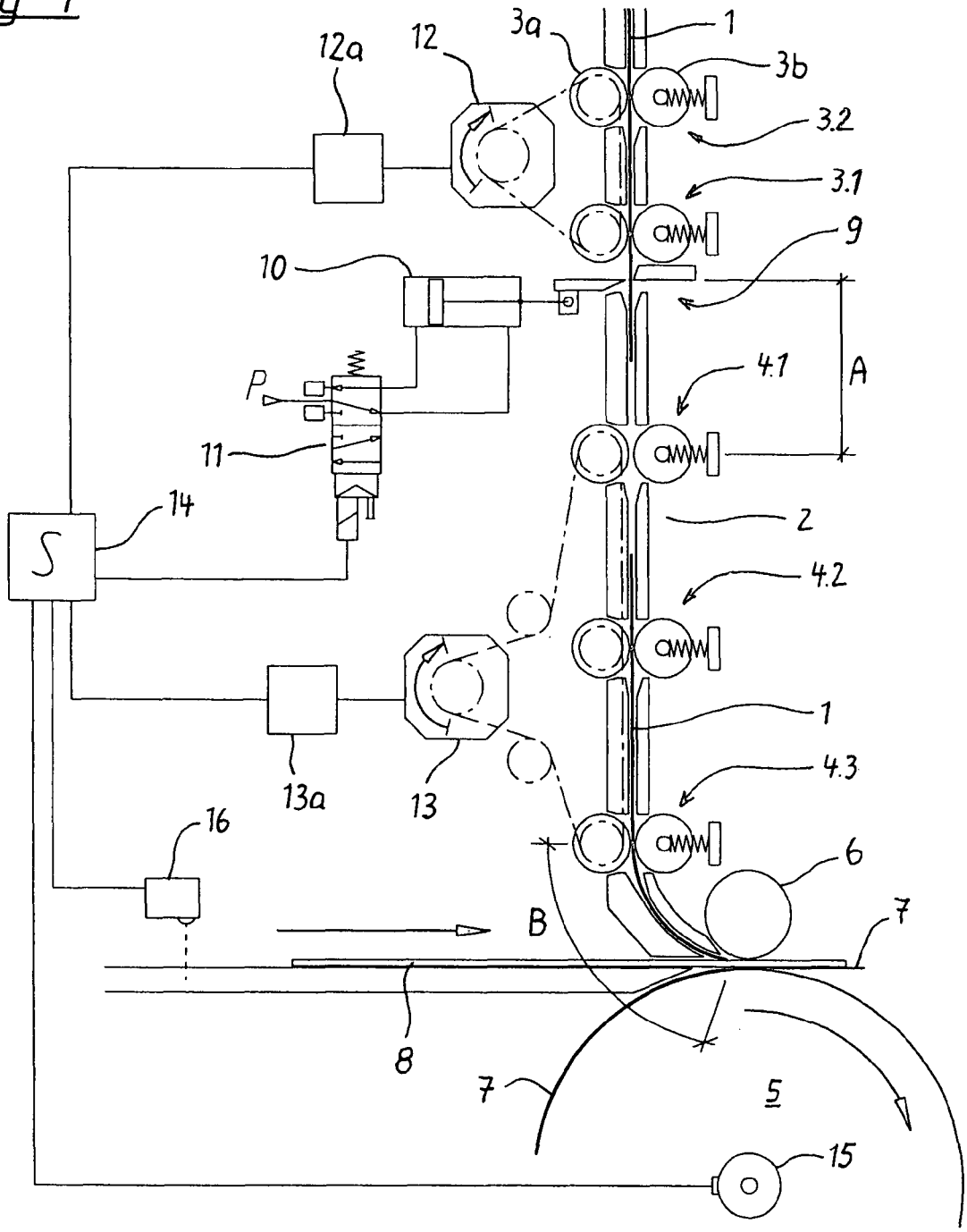
FIG. 1 is a schematic representation of the transport device.

As may be understood from the figures, the strip-like spine insert 1 is unwound from a not-shown supply reel and drawn forward into a transport channel 2 by first and second pairs of cut length transport rollers 3.1 and 3.2 that are spaced apart from one another and respectively composed of a driven roller and a spring-loaded roller 3*a* and 3*b*, wherein the spine insert is also positioned in a cutting device 9 for cutting off a spine insert 1 of the desired format length L.

Subsequently, pairs of feed rollers 4.1, 4.2 and 4.3 transport the cut-to-length spine insert 1 to a roller applicator that is composed of a cloth cylinder 5 and an upper roller 6, in synchronism with cyclically infed cover boards 8. In this case, a blank to be covered 7, which is provided with an adhesive, is applied on the cover boards 8 and the spine insert 1, whereby the protruding sides of the blank to be covered 7 are folded and pressed against the upper sides of the cover boards 8 and the spine insert 1 in ensuing turn-in stations that are not illustrated in greater detail.

The pairs of feed rollers 4.1, 4.2 and 4.3 are collectively driven by a separate servomotor 13. In order to synchronously bring together the book case components, its drive controller 13*a* is permanently synchronized with a shaft encoder 15 that detects the rotational movement of the cloth cylinder 5. The infeed of the cover boards 8 is scanned with the aid of a light barrier 16 in order to trigger a cyclic transport stroke $H_Z$ for the spine insert 1.

The pairs of feed rollers 4.1, 4.2 and the 4.3 have a constant transport stroke $H_Z$. The path curve 19 of the transport stroke $H_Z$ is illustrated in the motion diagram according to FIG. 2, in which the time t is plotted along the abscissa and the path s is plotted along the ordinate. After an acceleration in 19*a*, the transport takes place in synchronism with the cover boards 8. The path curves 18.1 and 18.2 respectively show the transport movement of one cut-to-length spine insert 1*a* to 1*c*, wherein the path curve 18.1 indicates the front edge and 18.2 indicates the rear edge of the spine insert 1.

The transport roller arrangement illustrated laterally adjacent to the motion diagram makes it clear that the spine insert 1 is only transported by the roller applicator itself after it emerges from the last pair of feed rollers 4.3 that is positioned at a distance B behind the roller applicator. The deceleration 19*b* at the end of the path curve 19 therefore no longer has any influence on the transport movement of the spine insert 1. Referred to the cycle time T, the transport stroke $H_Z$ takes place within a fixed infeed transport time $t_Z$.

An ensuing spine insert 1 is drawn forward while the cut-to-length spine insert 1 is fed to the roller applicator. The transport stroke $H_S$ that is variable in accordance with the format length L ends at the same time as the transport stroke $H_Z$ of the infeed transport. The pairs of cut length transport rollers 3.1 and 3.2 that are collectively driven by a separate servomotor 12 with assigned drive controller 12*a* carry out the transport in synchronism with the pairs of feed rollers 4.1, 4.2 and 4.3.

Figure 2:
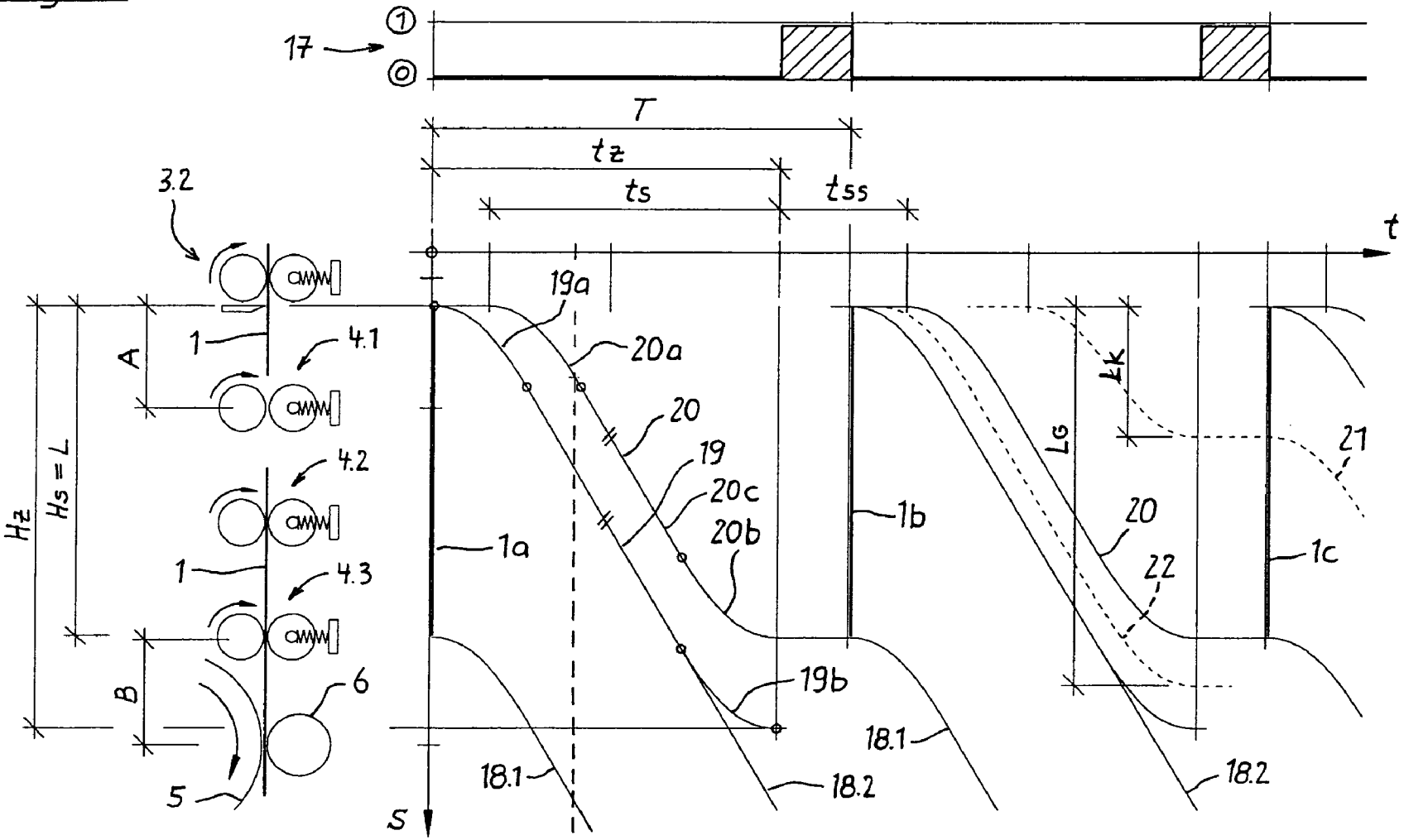
FIG. 2 is a motion diagram.

In the motion diagram according to FIG. 2, the path curve 20 for the leading edge of the material strip drawn forward by the pairs of cut length transport rollers 3.1 and 3.2 is shown for the format length L of the spine insert 1. The transport stroke $H_S$ takes place in the cut length transport time $t_S$. A standstill time $t_{SS}$ (dwell) elapses until the next spine insert 1 is drawn forward.

A glance at the laterally illustrated transport roller arrangement makes it clear that the transport movement $H_S$ is synchronized with the transport movement $H_Z$ of the pairs of feed rollers 4.1, 4.2 and 4.3 in a first motion segment of the acceleration 20*a*, and that the material strip is subsequently introduced into the first pair of feed rollers 4.1 that is arranged upstream of the cutting device 9 by the distance A. The spine insert 1 is then collectively transported by the pairs of cut length transport rollers 3.1 and 3.2 and the pairs of feed rollers 4.1, 4.2 and 4.3, wherein the deceleration 20*b* in the path curve 20 of the cut length transport is also in synchronism with the deceleration 19*b* of the infeed transport after a motion segment of constant speed 20*c*.

In order to elucidate the variable transport stroke $H_S$ of the pairs of cut length transport rollers 3.1 and 3.2, another path curve 21 for the smallest format length $L_K$ and a path curve 22 for the greatest format are also in the motion diagram.

A cutting process is triggered as soon as the common transport movement of the pairs of cut length transport rollers 3.1 and 3.2 and of the pairs of feed rollers 4.1, 4.2 and 4.3 comes to standstill. In this respect, the motion diagram shows the valve control 17 of a pneumatic valve 11 that controls a pneumatic cylinder 10 for carrying out the cutting process back and forward between a cutting on 1 and a cutting off 0 position.

The infeed of a spine insert 1 to the roller applicator can be realized as soon as the spine insert was cut off the material strip. Since the spine insert is transported away from the cutting device 9 in this case, the cutting knife can still be situated in the cutting on 1 position. It does not have to be switched into the cutting off position until an ensuing spine insert 1 is drawn forward by the pairs of cut length transport rollers 3.1 and 3.2. According to the motion diagram shown in FIG. 2, the process of drawing forward a spine insert even begins with a delay referred to the infeed transport when processing a spine insert 1 with the largest format length $L_G$ such that sufficient standstill time remains for controlling back the cutting knife into the cutting off 0 position.

The disclosed apparatus for the first time makes it possible to realize the above-described optimized motion sequence with a very short standstill time for cutting into lengths a spine insert 1 that was drawn forward. Due to the cutting process that takes place at a standstill, the cut-to-length spine inserts 1 have a very high cut length accuracy and can be fed to the roller applicator in rapid succession in order to realize a high output of book cases per cycle. The apparatus is characterized by a particularly clear and simple design. The servo motors 12 and 13 also make it possible to easily change the length and/or position of the spine insert 1 during the operation of a casemaker.

The invention claimed is:

1. An apparatus for cutting to length sections of a spine insert (1) that is unwound from a supply reel and for bringing together the spine inserts with infed cover boards (8) in a roller applicator (5, 6) for the mechanized production of book cases, comprising:

a cutting device (9);

at least one pair of cut length transport rollers (3.1) for drawing forward a defined drawing-off length (L) of the spine insert (1) and positioning the spine insert in the cutting device (9);

a plurality of pairs of feed rollers (4.1, 4.2, 4.3) for transporting the drawn and cut off length spine insert (1) of length (L) along a transport direction and into the roller applicator (5, 6);

independent drivers for the transport rollers (3.1) and the feed rollers (4.1, 4.2, 4.3);

a controller for the drivers whereby the feed rollers (4.1, 4.2, 4.3) are cyclically accelerated from and decelerated to a standstill with a constant stroke ($H_z$) and constant dwell ($T-t_z$) in order to transport the cut-to-length spine insert (1) from the cutting device (9) into the roller applicator (5, 6) in synchrony with the roller applicator (5, 6), while the cut-to-length spine insert is transported by both the feed rollers (4.1, 4.2, 4.3) and the roller applicator (5, 6), and the transport rollers (3.1) are accelerated from and decelerated to a standstill, in order to carry out a variable transport stroke ($H_s$) and variable dwell ($t_{ss}$) which variable transport stroke ($H_s$) is shorter than said constant stroke ($H_z$), and corresponds to the drawing-off length (L);

wherein the stroke ($H_z$) of the feed rollers has a first motion segment (19*a*) starting immediately following the dwell of the feed rollers (4.1, 4.2, 4.3) and the stroke ($H_s$) of the transport rollers has a first motion segment (20*a*) starting immediately following the dwell of the transport rollers (3.1), said stroke ($H_s$) of the transport rollers (3.1) starting after the start of the stroke ($H_z$) of the feed rollers (4.1, 4.2, 4.3) and accelerating to synchronize the motion of the transport rollers (3.1) with the motion of the feed rollers (4.1, 4.2, 4.3);

the stroke ($H_s$) of the transport rollers (3.1) and the stroke ($H_z$) of the feed rollers (4.1, 4.2, 4.3) have respective second motion segments (20*c*, 19) during which the transport rollers (3.1) are in synchronous movement with the feed rollers (4.1, 4.2, 4.3) and together with the feed rollers transport the spine insert (1) at constant speed;

the stroke ($H_s$) of the transport rollers (3.1) and the stroke ($H_z$) of the feed rollers (4.1, 4.2, 4.3) also have respective third motion segments (19*b*, 20*b*) during which the transport rollers (3.1) are in synchronous decelerating movement with the feed rollers (4.1, 4.2, 4.3) and the stroke ($H_s$) of the transport rollers (3.1) and the stroke ($H_z$) of the feed rollers (4.1, 4.2, 4.3) end at the same time;

the first (4.1) of the plurality of feed rollers (4.1, 4.2, 4.3) is at a first defined transport distance (A), downstream from the cutting device (9), and said first transport distance (A) is used as the first motion segment (20*a*) in which the transport rollers (3.1) accelerate a new spine (1) from a stopped condition to a synchronized condition with the feed rollers (4.1); and the last (4.3) of the plurality of feed rollers is at a second defined transport distance (B), upstream from the roller applicator (5, 6), and the second transport distance (B) is used as a last motion segment (19*b* and 20*b*) for decelerating of the common transport movement of the transport rollers (3.1) and the feed rollers (4.1, 4.2, 4.3) to respective standstill while a new spine insert (1) is drawn forward after the preceding spine insert (1) has departed said last feed roller (4.3).

2. The apparatus according to claim 1, wherein the spine insert (1) is synchronously transported by the feed rollers (4.1, 4.2, 4.3) while it is brought together with the infed cover boards (8).

3. The apparatus according to claim 2, wherein at least two pairs of cut length transport rollers (3.1, 3.2) are arranged at certain distances from one another.

4. The apparatus according to claim 1, wherein the cut length transport rollers (321) and the feed rollers (4.1, 4.2, 4.3) are respectively driven by servo motors (12, 13).

5. The apparatus according to claim 4, wherein the spine insert (1) is synchronously transported by the feed rollers (4.1, 4.2, 4.3) while it is brought together with the infed cover boards (8).

6. The apparatus according to claim 1, wherein at least two pairs of cut length transport rollers (3.1, 3.2) are arranged at certain distances from one another.

7. The apparatus according to claim 6, wherein the cut length transport rollers (321) and the feed rollers (4.1, 4.2, 4.3) are respectively driven by servo motors (12, 13).

* * * * *